United States Patent [19]

Marsch et al.

[11] 4,286,482

[45] Sep. 1, 1981

[54] DEVICE FOR POSITIONING ANCHORAGE MEANS

[75] Inventors: Walter Marsch, Recklinghausen; Hans Werner, Bottrop, both of Fed. Rep. of Germany

[73] Assignee: BWZ Berg-und Industrietechnik GmbH, Bottrop, Fed. Rep. of Germany

[21] Appl. No.: 108,421

[22] Filed: Dec. 31, 1979

Related U.S. Application Data

[63] Continuation of Ser. No. 899,679, Apr. 24, 1978.

[30] Foreign Application Priority Data

May 4, 1977 [DE] Fed. Rep. of Germany ..... 2719922
Oct. 13, 1977 [DE] Fed. Rep. of Germany ..... 2746073

[51] Int. Cl.[3] ..... B25B 17/00
[52] U.S. Cl. ..... 81/55
[58] Field of Search ..... 81/53 R, 55, 56, 59.1, 81/125.1

[56] References Cited

U.S. PATENT DOCUMENTS 3,916,734 11/1975 Sawan ..... 81/55 X
4,048,875 9/1977 Heinen et al. ..... 81/121 R X

FOREIGN PATENT DOCUMENTS 2334872 7/1977 France ..... 81/59.1

*Primary Examiner*—James G. Smith
*Attorney, Agent, or Firm*—James C. Wray

[57] ABSTRACT

A unidirectional mechanism slides along guides within a casing against a spring. A recess in one end of the unidirectional mechanism receives the head of an anchor bolt, and a cover on the casing near that end receives a nut on the anchor bolt.

Turning the casing in a counterclockwise direction engages the one-way mechanism, turning both the anchor bolt and the nut. When the anchor bolt is secure, the casing is turned clockwise. The one-way mechanism automatically disengages and the nut is turned on the anchor bolt without turning the anchor bolt.

12 Claims, 3 Drawing Figures

DEVICE FOR POSITIONING ANCHORAGE MEANS

Figure 2:
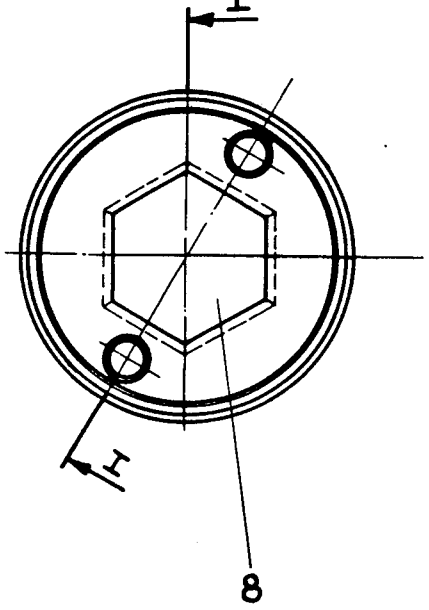

This is a continuation, of application Ser. No. 899,679, filed Apr. 24, 1978.

The invention concerns a device for positioning anchor means, particularly an anchor bolt such as a rag bolt or the like and is especially applicable where the bolt, at its end projecting from the borehole, has a screwthread for a nut for securing a plate, say, and means, e.g. flats, for transmitting a moment of rotation from a tool.

Anchor bolts and the like are used in increasing extent in rock workings, e.g. quarrying and underground mine and tunnel workings, because there may be achieved thereby a better adhesion between the ground or rock and the anchor bolt. On insertion of the anchor bolt, firstly one or more cartridges containing the components of a synthetic resin cement or adhesive, are placed in the borehole. Then the bolt is inserted rotatingly into the borehole, whereby the cartridges are crushed, the components of the synthetic resin cement mixed and the synthetic resin cement is distributed in the borehole. After hardening of the synthetic resin cement the nut is rotated towards an anchor plate positioned in front of the mouth of the borehole and thereby the bolt is tensioned. The anchor plate can serve at the same time for the attachment of wire mesh or another covering to the rock. In the case of bolts which, in addition to a threaded end, also have flats for the attachment of a rotating tool, the tool e.g. a hammer drill, rotary sledge hammer or percussion screw driver is coupled to the flats, by means of an attachment piece conforming to the flats, whereupon the anchor bolt is driven rotatingly into the borehole. When the anchor bolt has experienced a more or less firm adhesion in the borehole, the tool, or another tool, is set up with a further attachment piece conforming to the nut and the nut rotated towards the anchor plate situated in front of the mouth of the borehole, whereby simultaneously the bolt is tensioned and the anchor plate pressed against the rock. That requires several operational steps and is therefore expensive.

The object of the invention is to simplify the insertion of anchor bolts such as rag bolts or the like, which in addition to a screwthread also have means, e.g. flats, for the attachment of a tool e.g. a drill with reversible rotation, and the like.

According to the present invention there is provided a device for positioning anchor bolts or the like having a nut on a threaded end thereof, comprising a rotatable casing, which at one end face has for reception of the nut an opening with a cross-section corresponding to the flats of the nut, and in which casing is secured non-rotatably a rotation-direction locking mechanism, having a part movable relative to the casing arranged for reception and entrainment of the anchor bolt end portion. Preferably the rotation-direction locking mechanism is secured in the casing in the region of the end opposite to the reception end, and its movable part has a recess with entrainment faces corresponding to flats of the anchor bolt end.

To insert an anchor bolt the casing is positioned upon the screwthreaded end of the portion of the bolt projecting out of the borehole, so that the opening of the casing directed towards the borehole embraces and holds the nut screwed onto the screwthreaded end of the bolt, while the flats on the end of the bolt engage in the corresponding recess of the movable part of the rotation-direction locking mechanism. Through rotation of the casing in the locked direction of the locking mechanism the anchor bolt is rotated in this direction and can be inserted into the borehole, whereby the cartridge or cartridges are crushed. The nut seated on the screwthreaded end of the bolt is thereby not rotated relative to the anchor bolt. When the bolt has experienced an adhesion in the borehole, either the stop in the rotation-direction locking mechanism is released, or the direction of rotation of the tool is reversed. Thereby the nut on the screwthreaded end of the bolt is rotated towards the anchor plate and the bolt tensioned and an anchor plate with wire-netting pressed against the rock.

An anchor bolts and the like generally have a right hand thread at the end projecting out of the borehole, one uses simple rotation-direction locking mechanisms which are so adjusted that they lock in the anticlockwise direction. Then for insertion of the anchor bolt the casing is rotated firstly in the anticlockwise direction. When the anchor bolt has experienced an adequate adhesion in the borehole, the direction of rotation is reversed, so that the casing then drives only the nut and rotates this towards the anchor plate. If a power tool is used for positioning the anchor bolt, then its direction or rotation must be reversible. Tools of such a kind are available.

A simple embodiment is characterised in that the casing is closed by a base plate and that the locking mechanism is secured interiorly of the base plate. The locking mechanism can be a ratchet, a pawl mechanism, a friction-ratchet or a roller friction-ratchet. As already referred to above, it may be a simple locking mechanism, whose lock is neither releasable nor reversible.

In order to minimize the expense for the treatment of the anchor bolts, it can be advantageous, for the recess to be formed for reception of a twin flat. However other arrangements of the drive faces in the recess in conformity with existing flats of anchor bolts or the like is possible. Furthermore the casing ought also to have attachment means for the connection of a tool. Such attachment means may comprise flats, which are suitably arranged on a pin projecting outwardly of the base plate.

Although this device is generally satisfactorily, a disadvantage emerges, if the bolt is too long or the bolt thus projects further than provided for because some stone is broken away at the borehole mouth. In this case the nut leaves the casing during the tightening operation and cannot be tightened down further.

In order that the device can also be used for positioning bolts whose ends project far from the borehole, it can be advantageous if the rotation-direction locking mechanism is arranged axially movable in the casing and is supported on the base plate of the casing by a spring. Operation of this device is basically the same as that described earlier. Certainly it is possible to also fix bolts, which project relatively far out of the borehole mouth, because a relatively large displacement is possible between the nut and bolt end by sliding in the casing.

If after the adhesion of the anchor bolt in the borehole bottom the nut is rotated relative to the bolt and thereby is displaced relative to the anchor bolt end, the receiver for the flats of the bolt is pushed into the casing due to forcing of the casing towards the rock and against the action of the spring. If after termination of the positioning operation the pressure is lifted and the device removed from the bolt, then the spring restores the receiver to the rest position in the region of the opening for the nut. By these means the rotation-direction locking mechanism is also displaced axially within the casing.

In order to prevent rotation of the outer part of the locking mechanism in the casing, the mechanism and the casing can have complementary external cross-section and internal cross-section respectively. The rotation-direction locking mechanism especially can at least have a radial projection which engages in an axial internal groove of the casing. In that way the displaceability of the rotation-directional locking mechanism is totally preserved, while the outer part of the mechanism is secured against rotation relative to the casing.

The spring can be a coil spring, which is supported upon central pins, on the one hand at the baseplate of the casing, and on the other hand at the base-facing end face of the rotation locking mechanism. The pins can at the same time form abutments, which define the allowable spring travel and in that way prevent over-stressing of the spring.

A stop for the directional rotation locking mechanism may comprise a retaining ring inserted into the casing.

As the tie bolt end with the flats generally has parallel flats and inner parts of commercially available directional rotation-locking mechanisms generally have otherwise profiled receivers, it can be advantageous, if the receiver for the tie bolt end is formed by a member fastened to the movable part of the directional rotation locking member on its abutment face and rotatable in the casing, that has a recess with drive faces conforming with the flats.

This member, with the receiver for the flats, can at the same time also serve as an abutment for the nut on the occasion of application of the device to the tie bolt end, especially in one embodiment, in which the casing has a larger internal cross-section than the nut and in which, at that end of the casing facing the borehole, is arranged a cover, secured against rotation oppositely to the casing and immovable axially, which has a through opening with a cross-section conforming with the flats-spacing of the nut. Such an embodiment is moreover also advantageous in manufacture because it can be assembled from components that must be processed only a little. The cover can be secured to the casing with axial dowel pins and radial spring-loaded pins.

Figure 1:
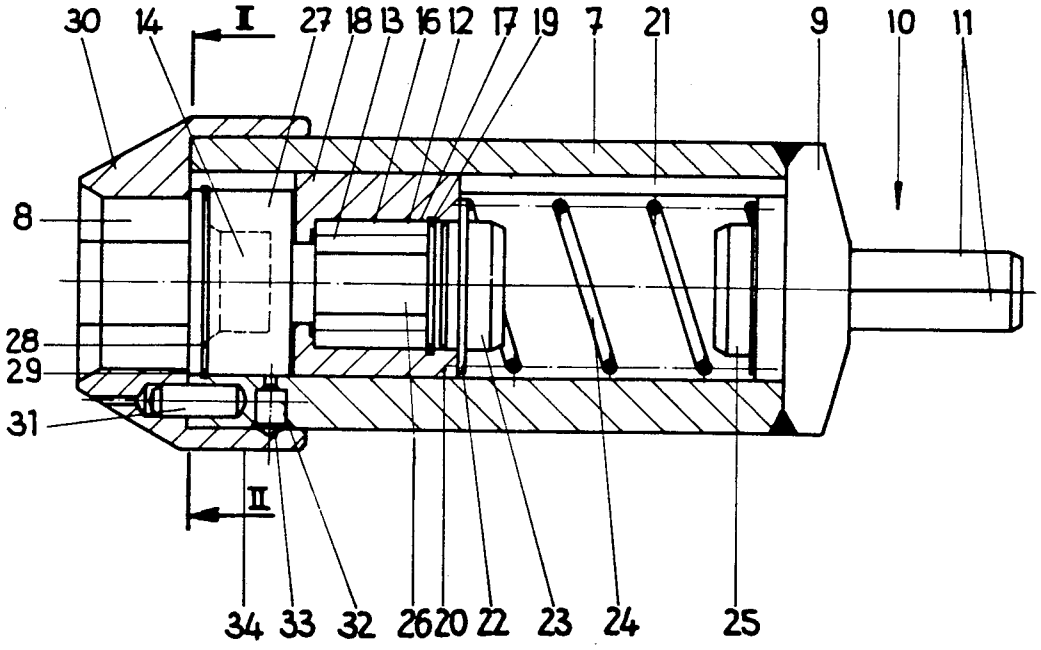

In the following exemplary embodiments are described with reference to the drawing, which shows:

FIG. 1 a longitudinal section through a device for the positioning anchor bolts or the like corresponding to the section line I—I in FIG. 2.

FIG. 2 a section in the direction II—II through the device of FIG. 1.

Figure 3:
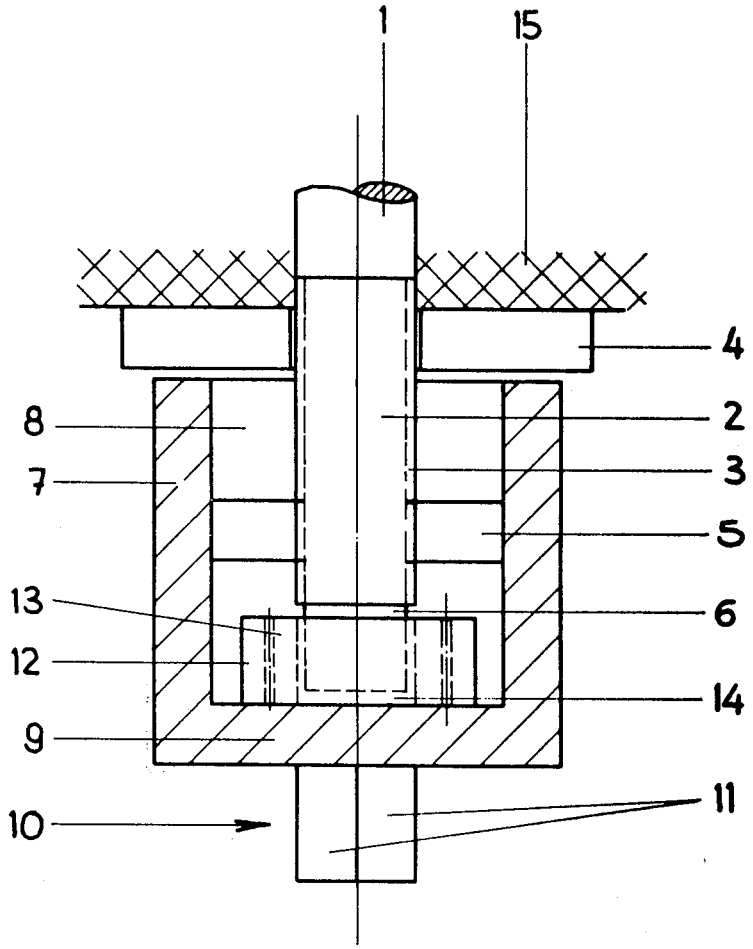

FIG. 3 another embodiment of the device according to FIG. 1.

The device shown in FIGS. 1 and 2 for insertion of an anchor bolt comprises a casing 7 which is closed at one end by a base plate 9. The plate 9 is, in the case of the exemplary embodiment shown, welded to the casing 7. The base plate 9 carries on its outer side a releasable pin 10 with flats 11 for the attachment of a tool (not shown).

In the casing 7 a ratchet 12 is arranged, non-rotatably but movable axially, as a direction-of-rotation locking mechanism, whose outer part 16 is secured, immovable axially and non-rotatably, in the greater part of a stepped recess 17 of a bush 18 axially movable in the casing 7. A retaining ring 19, which engages in a corresponding inner groove of the stepped recess, secures the outer part 16 of the ratchet 12. The bush 18 has at opposing external sides an axially extending ridge 20 and the ridges 20 engage in corresponding axial grooves 21 in the inner circumference of the casing. Thereby the bush 18 together with the ratchet 12 is held non-rotatably but axially displaceable in the casing. On the rear face of the bush 8, directed towards the base plate 9, lies a loose flange or washer 22 which is carried by a central pin 23. On the washer 22 bears a coil spring 24, in which the central pin engages. The other end of the coil spring is located on a central pin 25 fastened to the base plate 9. Under the action of the spring the bush 18, with ratchet 12, is biassed away from the plate 9.

The inner part 13 of the ratchet 12 is movable oppositely to the outer part 16 in one rotational direction and blocked in the other direction. The inner part 13 has a recess for a pin 26, which in this recess is secured immovable axially and rotationally e.g. by means of shrinkage or the like. The pin 26 belongs to a member 27, which is still arranged in the casing 7 and can move axially and rotationally relative thereto. In the case of the illustrated embodiment the casing 7, with the exception of the axial grooves 21, has a circular cross-section, and correspondingly the member 27 likewise has a circular cross-section. The member 27 bears with its end face 28 on a suitable internal retaining ring 29 in the region of the end of the casing, which thus at the same time forms an abutment for the bush 18, with the ratchet 12, against the action of the coil spring 24. In the face 28 is a recess 14 for the profiled anchor bolt end. As the ends of anchor bolts are formed generally with two parallel flats the recess 14 can have an oval cross-section with drive faces matched with the flats of the anchor bolt end.

Moreover, on the end of the casing opposite to the base plate 9, is arranged a cover 30 which is held on the one hand by the axial pins 31 and on the other hand by radial spring-loaded pins 32 to the casing. It will be noted, that the axial pins 31 are respectively assigned to corresponding recesses viz. bores, and that the radial spring-loaded pins 32 are held in corresponding blind holes of the casing 7 and engage in an inner circumferential groove 33 of the collar 34 surrounding the end of the casing.

The cap 30 has a through hole 8 with a cross-section corresponding to the flats-spacing of the nut for the anchor bolt; in the case of the illustrated embodiment a hexagonal section.

The illustrated device operates as follows: For positioning an anchor bolt (not shown) the casing 7 with the opening 8 is positioned on the end of the anchor bolt projecting out of the borehole and the nut screwed thereon, so that the nut is in the opening 8 and can bear upon the end face 28 of the member 27, while at the same time the flatted end portion of the bolt engages in the recess 14 of the member 27. With a power tool coupled to the pin 10, the casing 7 and therewith the bush 18, the ratchet 12, and finally the member 27 with the anchor bolt, is driven rotating into the borehole, until one or more cartridges, with the components of a plastics cement, previously interposed in the borehole are crushed and the components of the plastics cement mixed and distributed. When the anchor bolt inserted deeply into the borehole experiences a more or less strong adhesion, the direction of rotation of the tool acting on the pin 10 is reversed, so that the casing is rotated clockwise. Thereby the casing 7 rotates with it the member 18 and the outer part 16 of the ratchet 12, but not the inner part 13 with the member 27 and the anchor bolt. On the other hand by the rotation of the casing 7 the nut situated in opening 8 is entrained and rotates with the casing, and hence in the direction of the borehole, viz. towards an anchor or tie plate arranged in front of the borehole, until it presses the anchor plate against the ground surrounding the borehole mouth and thereby tensions the anchor bolt.

During this procedure, by means of pressure applied to the pin 10, the profiled end of the bolt with the member 27, the bush 18, and the members arranged therein, are shifted against the action of the spring 24 in the direction of the base plate 9 of the casing. When the nut is securely tightened and the device pulled away from the anchor bolt end, the bush 18, with the connected members, is displaced under the action of the spring 24 towards the cover 30 again until the end face 28 of the member 27 strikes against the retaining ring 29. Then the device is ready for the next operation.

It is necessary e.g. for lowering loads, that in the case of individual anchor bolts, the bolts project further from the borehole, than for the other anchor bolts. This is possible with the new device with satisfactory screwing down of the nut. For small differences in length the spring extension suffices, for larger length differences one takes either a longer cover 30 or one provides a removable auxiliary stop for the central pin 23, or both.

In FIG. 3 is shown a tie rod 1 inserted into a borehole. The tie rod has on its end 2 projecting from the borehole a screwthread 3. The thread 3 is a right handed thread. Over the end 2 is provided an anchor plate 4, which with a nut 5 screwed partially onto the thread 3, simultaneous strain of the tie rod 1 should be pressed against the opening of the borehole. The nut 5 is a hexagonal nut. At the end 2 with the screwthread 3 is formed a pin formed as two flats 6. The tie rod is part of an anchor bolt.

A device for positioning the bolt comprises a casing 7 with an opening 8 situated at the end face directed away from the borehole, whose cross-section is adapted to the cross-section of the nut 5. In the above case the opening 8 has an essentially hexagonal cross-section. At the opposite end face the casing 7 is closed by a plate 9, which outwardly has a pin 10 with drive faces 11 for the attachment of a rotating tool.

In the interior of the opening 8, secured on the plate 9, is a rotation-direction locking mechanism formed by a ratchet 12, whose inner movable part 13 has a recess 14 arranged with drive faces corresponding to the two flats 6.

The ratchet 12 is so designed that for anti-clockwise rotation the movable part 13 is entrained. The connections between on the one hand the casing 7 and the base plate 9 and on the other hand the base plate 9 and the pin 10 can be releasable. Through this the casing 7 can be employed with nuts of various flat-spacings and the pin 10 with recesses with various internal face spacings, and moreover, if necessary, the ratchet 12 can be readily replaced.

For inserting the anchor bolt the casing 7 is positioned with its opening 8 upon the end 2 of the bolt and the nut screwed thereupon, so that the nut 5 is held in the opening 8 and the twin flats 6 engage in the recess 14 of the ratchet 12. With a power tool coupled to the pin 10, the casing 7, and therewith the anchor bolt 1, is driven rotatingly into the bore hole, until one or more pellets previously located in the bore hole, containing the components of a synthetic resin cement, are crushed and the components of the synthetic resin cement are mixed and distributed. When the anchor bolt 1 reaches the bottom of the bore hole and has experienced a more or less strong adhesion, the rotation of the tool engaged upon the pin 10 is reversed, so that the casing 7 is rotated in the clockwise direction. Thereby the anchor bolt 1 is no longer rotatably entrained because the movable part 13 in the ratchet 12 can run freely. On the other hand however the nut 5 is rotated by the casing 7 and thereby moves towards the anchor plate 4, until it presses this against the ground 15 surrounding the bore hole mouth, and thereby tensions the bolt 1.

In this way it is possible to carry out the installation of the anchor bolt with only one operation.

We claim:

1. A device for fixing of an anchor bolt or the like having at its bolt and projecting out of the bore hole a screw thread for a nut for securing a plate and means for transmission of rotational movement of a tool, the device comprising a rotatable casing which has at one end an opening with a cross-section corresponding to the flat-spacing of the nut for reception of the nut and in which casing is secured non-rotatably an axially slideable bush and a rotation-direction locking ratchet mounted in the bush and movable with the bush axially relative to the casing, the ratchet having an outer part, the outer part being fixed in the bush, and the bush and the casing having complementary external and internal cross section, respectively, to prevent relative rotation thereof and the ratchet having an inner part with a recess adapted for insertion and entrainment of the anchor bolt end, the casing having a base plate at an end opposite the opening and a spring between the base plate and the bush which holds the ratchet urging the bush and the ratchet away from the plate toward the opening.

2. A device as claimed in claim 1, wherein the bush and the rotation-direction locking ratchet is positioned in the casing at the end opposite to the nut-receiving end and its movable part has a recess with drive surfaces corresponding to the said means for transmitting rotational movement.

3. A device as claimed in claim 2, wherein the recess is adapted for reception of twin flats.

4. A device as claimed in claim 1, wherein the casing has attachment means for the connection of a tool.

5. A device as claimed in claim 4, wherein the attachment means comprises flats on a pin projecting outwardly of a base plate.

6. A device as claimed in claim 1, wherein the bush which holds the rotation-direction locking ratchet has at least one radial projection, which engages in an axial groove of the casing.

7. A device as claimed in claim 1, wherein the spring is a helical spring, which is supported upon central pins disposed, respectively, on the base plate of the casing and on an end face of the bush which holds the rotation-direction locking ratchet directed towards the base plate.

8. A device as claimed in claim 7, including an abutment in the form of a retaining ring provided in the casing and an abutment face connected to the bush which holds the locking mechanism and contacting the face.

9. A device as claimed in claim 1, wherein the casing has a larger internal cross-section than the nut and arranged at the end of the casing adjacent the opening is a cover rotationally and axially immovable relative to the casing, which cover has a through opening with a cross-section corresponding with the flats of the nut.

10. A device as claimed in claim 9, wherein the cover is fastened to the casing by axial dowel pins and radial spring-loaded pins.

11. A device as claimed in claim 7, including between the central pins an adjustable auxiliary stop for the movable central pin.

12. A device as claimed in claim 9, including an interchangeable cover for variation of length.

* * * * *